US005461403A

United States Patent [19]

Wallace et al.

[11] Patent Number: 5,461,403

[45] Date of Patent: Oct. 24, 1995

[54] DROPLET VOLUME MODULATION TECHNIQUES FOR INK JET PRINTHEADS

[75] Inventors: David B. Wallace, Dallas; James L. Stortz, Spring, both of Tex.

[73] Assignee: Compaq Computer Corporation, Houston, Tex.

[21] Appl. No.: 60,294

[22] Filed: May 10, 1993

Related U.S. Application Data

[63] Continuation-in-part of Ser. No. 746,521, Aug. 16, 1991, Pat. No. 5,227,813.

[51] Int. Cl.[6] ..... B41J 2/045; B41J 2/205

[52] U.S. Cl. ..... 347/10; 347/15; 347/68

[58] Field of Search ..... 346/1.1, 140 R; 310/316, 317; 347/9, 10, 11, 15, 68, 69, 71; B41J 2/045

[56] References Cited

U.S. PATENT DOCUMENTS

| | | | |
|---|---|---|---|
| 3,857,049 | 12/1974 | Zoltan | 310/8.1 |
| 4,383,264 | 5/1983 | Lewis | 346/140 R |
| 4,468,680 | 8/1984 | Martner | 346/140 R |
| 4,513,299 | 4/1985 | Lee et al. | 346/140 |
| 4,514,742 | 4/1985 | Suga et al. | 346/140 R |
| 4,523,200 | 6/1985 | Howkins | 346/1.1 |
| 4,523,201 | 6/1985 | Liker | 346/1.1 |
| 4,536,097 | 8/1985 | Nilsson | 400/126 |
| 4,584,590 | 4/1986 | Fischbeck et al. | 346/140 R |
| 4,675,693 | 6/1987 | Yano et al. | 346/1.1 |
| 4,743,924 | 5/1988 | Scardovi | 346/140 |
| 4,752,790 | 6/1988 | Scardovi | 346/140 |
| 4,825,227 | 4/1989 | Fischbeck et al. | 346/1.1 |
| 4,879,568 | 11/1989 | Bartky et al. | 346/140 R |

(List continued on next page.)

FOREIGN PATENT DOCUMENTS

| | | | |
|---|---|---|---|
| 0364136 | 4/1990 | European Pat. Off. | B41J 2/045 |
| 0402172 | 12/1990 | European Pat. Off. | B41J 2/045 |
| 0437106 | 7/1991 | European Pat. Off. . | |
| 0485241 | 5/1992 | European Pat. Off. | B41J 2/045 |
| 0513971 | 11/1992 | European Pat. Off. . | |
| 0580154 | 1/1994 | European Pat. Off. . | |
| 3820082 | 12/1988 | Germany . | |
| 3924957 | 7/1989 | Germany . | |
| 3924948 | 7/1989 | Germany . | |
| 55-65568 | 5/1980 | Japan . | |
| 1-275051 | 11/1989 | Japan . | |

OTHER PUBLICATIONS

Patent Abstracts of Japan, vol. 14, No. 46, Jan., 1990.

Wallace, David B., entitled "A Method of Characteristic Model of a Drop–on–Demand Ink–Jet Device Using an Integral Method Drop Formation Model", *89–WA/FE–4* (1989).

Tsao, C. S., entitled "Drop–on–Demand Ink Jet Nozzle Array with Two Nozzles/Piezoelectric Crystal", *IBM Technical Disclosure Bulletin,* vol. 23 No. 10 (Mar. 1981).

*Primary Examiner*—Benjamin R. Fuller
*Assistant Examiner*—Alrick Bobb
*Attorney, Agent, or Firm*—Konneker & Bush

[57] ABSTRACT

An ink jet printhead and an associated method for operatively driving the ink jet printhead to cause the ejection of a volume modulatable droplet from an ink-carrying channel thereof partially defined by a piezoelectric sidewall actuator. The voltage applied across the sidewall actuator is raised from a rest voltage to a first voltage to deflect the sidewall actuator from a rest position to a first position and maintained at the first voltage for a first period of time. The voltage applied across the sidewall actuator is then dropped to a second voltage, lower than the rest voltage, to deflect the sidewall actuator from the first position, past the rest position, to a second position and maintained at the second voltage for a second period of time. The voltage applied across the sidewall actuator is then returned to the rest voltage to deflect the sidewall actuator back to the rest position. The first and second time periods are selected, relative to each other, to select a droplet volume for ink ejected from the ink-carrying channel. The voltage applied across the sidewall actuator is then returned to the rest voltage, thereby causing the ejection of a droplet of ink having the selected droplet volume.

21 Claims, 4 Drawing Sheets

U.S. PATENT DOCUMENTS 4,887,100 12/1989 Michaelis et al. ..... 346/140 R
4,931,810 6/1990 Iwata et al. ..... 346/1.1
4,963,882 10/1990 Hickman ..... 346/1.1
5,016,028 5/1991 Temple ..... 346/140 R
5,138,333 8/1992 Bartky et al. ..... 346/1.1
5,221,931 6/1993 Moriyama ..... 346/1.1
5,227,813 7/1993 Pies et al. ..... 346/140 R
5,248,998 9/1993 Ochiai et al. ..... 346/140 R

DROPLET VOLUME MODULATION TECHNIQUES FOR INK JET PRINTHEADS

CROSS REFERENCE TO RELATED APPLICATIONS

This application is a Continuation-in-Part of U.S. patent application Ser. No. 07/746,521, U.S. Pat. No. 5,227,813 filed Aug. 16, 1991, assigned to the Assignee of the present application, and hereby incorporated by reference as if reproduced in its entirety.

This application is further related to the following co-pending patent applications:

| Ser. No. | First Named Inventor | Title |
|---|---|---|
| 08/060,440 | Stortz | Spot Size Modulatable Ink Jet Printhead |
| 08/060,295 | Stortz | Switched Digital Drive System For An Ink Jet Printhead |
| 08/060,296 | Stortz | Differential Drive System For An Ink Jet Printhead |
| 08/060,297 | Stortz | Dual Element Switched Digital Drive System For An Ink Jet Printhead |
| 08/060,298 | Williamson | Three Element Switched Digital Drive System For An Ink Jet Printhead |

All of the above listed applications were filed on even date herewith, assigned to the Assignee of the present invention, and are hereby incorporated by reference as if reproduced in their entirety.

BACKGROUND OF THE INVENTION

1. Field of the Invention

The present invention generally relates to ink jet printhead apparatus and, more particularly, to a method for piezoelectrically driving a drop-on-demand type ink jet printhead such that the volume of ink contained in droplets ejected thereby may be modulated.

2. Description of Related Art

Ink jet printing devices use the ejection of tiny droplets of ink to produce an image. The devices produce highly reproducible and controllable droplets, so that a droplet may be printed at a location specified by digitally stored image data. Most ink jet printing devices commercially available may be generally classified as either a "continuous jet" type ink jet printing device where droplets are continuously ejected from the printhead and either directed to or away from the paper depending on the desired image to be produced or as a "drop-on-demand" type ink jet printing device where droplets are ejected from the printhead in response to a specific command related to the image to be produced.

Many drop-on-demand type ink jet printheads utilize electromechanically induced pressure waves to produce the desired droplets of ink. In one representative configuration thereof, a drop-on-demand type ink jet printhead has a horizontally spaced parallel array of internal ink-receiving channels. These internal channels are covered at their front ends by a plate member through which a spaced series of small ink discharge orifices are formed. Each channel opens outwardly through a different one of the spaced orifices. Within such a printhead, a volumetric change in fluid contained in the internal channels is induced by the application of a voltage pulse to a piezoelectric material which is directly or indirectly coupled to the fluid. This volumetric change causes pressure/velocity transients to occur in the fluid and these are directed so as to force a small, fixed quantity of ink, in droplet form, outwardly through the discharge orifice at a fixed velocity. The droplet strikes the paper at a specified location related to the image being produced and forms an ink "spot" having a diameter directly related to the volume of the ejected droplet.

Due to their ability to produce a spot at any location on a sheet of paper, ink jet and other non-impact printers have long been contemplated as particularly well suited to the production of continuous and half tone images. However, the ability of ink jet printers to produce continuous and half tone images has been quite limited due to the fact that most ink jet printheads can only produce droplets having both a fixed volume and a fixed velocity. As a result, ink spots produced by such droplets striking a sheet of paper are of a fixed size, typically in the range of 120 μm to 150 μm, and the same intensity. Additionally, all ink jet printheads use a fixed resolution, typically 300–400 dpi (or "dots per inch") or lower, to place droplets on a sheet of paper. In contrast, a typical high quality half tone image is produced using up to 256 levels of variable sized spots at resolutions of up to 240 dots per inch.

Due to the aforementioned limitations, ink jet printheads have heretofore utilized spot density, as opposed to spot size, when attempting to produce a grey scale image. To do so, the ink jet printhead creates various shades of gray by varying the density of the fixed size ink spots. Darker shades are created by increasing spot density and lighter shades are created by reducing spot density. Producing a grey scale image in this manner, however, reduces the spacial resolution of the printer, thereby limiting its ability to produce finely detailed images. Furthermore, the more levels added to the grey scale, the greater the resultant degradation of the printer's spacial resolution. A second proposed solution has been to direct multiple droplets at a single location on the sheet of paper to form variably sized spots. While such a method can produce the desired images, such a technique reduces the speed of the printer to unacceptably slow speeds.

The technology for varying droplet size is known, but the velocity of the droplets produced thereby tends to change with its volume. As a result, droplet placement accuracy is lowered significantly before the droplet volume is significantly decreased. Furthermore, without droplet placement accuracy, the usefulness of such technology in the printing arts is quite minimal.

It can be readily seen from the foregoing that it would be desirable to provide an improved drop-on-demand type ink jet printhead drive system that can modulate the volume of droplets produced thereby without significantly varying the velocity at which the variously sized droplets are ejected. It is accordingly an object of the present invention to provide such an improved drop-on-demand type ink jet printhead.

SUMMARY OF THE INVENTION

In one embodiment, the present invention is of a method for operatively driving a piezoelectric sidewall actuator of an ink jet printhead to cause the ejection of a droplet of ink having a selected volume from an ink-carrying channel at least partially defined by the sidewall actuator. The voltage applied across the sidewall actuator is raised from a rest voltage to a first voltage to deflect the sidewall actuator from a rest position to a first position and maintained at the first voltage for a first period of time. The voltage applied across the sidewall actuator is then dropped to a second voltage, lower than the rest voltage, to deflect the sidewall actuator from the first position, past the rest position, to a second position and maintained at the second voltage for a second period of time. The first and second time periods are selected, relative to each other, to select a droplet volume for ink ejected from the ink-carrying channel. The voltage applied across the sidewall actuator is then returned to the rest voltage, thereby causing the ejection of a droplet of ink having the selected droplet volume.

In alternate aspects of this embodiment of the invention, the second time period is held constant and the first time period is varied to select the droplet volume or the first time period is held constant and the second time period is varied to select the droplet volume. In still further aspects of this embodiment of the invention, the first period is held to 20 μsec and the second period of time varied between 8–20 μsec to select a droplet volume between 35–65 pl.

In another embodiment, the present invention is of a method of ejecting a volume modulatable droplet of ink from a selected ink-carrying channel of an ink jet printhead having a plurality of ink-carrying channels, each separated from an adjacent channel by a sidewall actuator, by imparting an expansive pressure pulse into a channel, propagating the expansive pressure pulse for a first period of time, imparting a compressive pressure pulse into the channel, propagating the compressive pressure pulse for a second period of time, and removing the compressive pressure pulse to cause the ejection of a droplet of ink from the channel. The volume of ink contained in the ejected droplet is controlled by the selection of the first and second time periods.

In one aspect of this embodiment of the invention, the expansive pressure pulse is imparted by generating, at originating locations within the first ink-carrying channel, forwardly and rearwardly propagating pressure waves. The rearwardly propagating pressure wave reflects off a back wall of the channel towards the front end. Propagation of the expansive pressure pulse is maintained until the reflected pressure wave returns to the originating location. The compressive pressure pulse into the channel is then imparted by again generating forwardly and rearwardly propagating pressure waves in the channel. The forwardly propagating pressure wave reinforces the forwardly propagating reflected pressure wave. An active pull-up pressure pulse is then imparted into the channel to form the droplet of ink to be ejected from the channel. In another aspect, a droplet having a volume variable between about 1 and 1.8 volumes is produced by varying the second time period between a ratio of about 0.4 to 1.0 of the first time period.

In yet another embodiment, the present invention is of a method for ejecting a volume modulatable droplet of ink from a selected ink-carrying channel of an ink jet printhead having a plurality of ink-carrying channels, each separated from an adjacent channel by a sidewall actuator, by imparting a primary pressure pulse to a channel by deflecting first and second sidewall actuators partially defining the first channel such that the first channel is expanded and second and third channels partially defined by the first and second sidewall actuators, respectively, are compressed. An echo pressure pulse is then imparted to the first channel by deflecting the first and second sidewall actuators such that the first channel is compressed and the second and third channels are expanded, thereby causing the ejection of a droplet of ink by the first ink-carrying channel. A volume for the ejected droplet of ink is controlled by selection of the primary and echo pulses. In one aspect of this embodiment of the invention, the primary and echo pulse both include rise, dwell and fall portions and the droplet volume is controlled by selection of the dwell times for the pulses.

In still yet another embodiment, the present invention is of a drop-on-demand type ink jet printhead having a main body portion having at least one ink-carrying channel extending therethrough and means for selectively ejecting ink droplets of various volumes at a nearly constant velocity from the channels. In one aspect of this embodiment of the invention, the ink jet printhead further includes means for imparting a primary pulse into the channel to produce a first acoustic wave, means for imparting an echo pulse into the channel to produce a second, reinforcing, acoustic wave, and means for prematurely terminating the reinforced acoustic wave to cause the ejection of a droplet of ink having a selected volume. In another aspect, the selective ejection means may further include means for ejecting ink droplets having a volume variable between about 1.8:1 travelling at a velocity variable between about 1.2:1.

DETAILED DESCRIPTION

Figure 1:
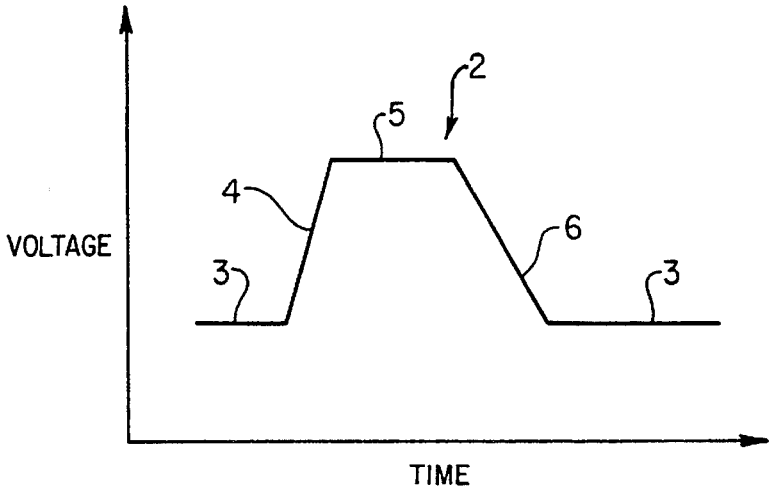
FIG. 1 is a graphical illustration of a standard, trapezoidal, pulse for generating an acoustic pressure wave in a channel of an ink jet printhead.

Referring first to FIG. 1, a voltage waveform 2 which includes a standard, trapezoidal, pulse used for generating an acoustic pulse in an ink-carrying channel of an ink jet printhead to cause the ejection of a droplet of ink therefrom will now be described in greater detail. From a rest state 3, during which a rest state voltage is applied across a piezoelectric actuator, the voltage waveform 2 begins a rapid rise 4, typically on the order of about 5 μsec in duration, in the voltage applied across the piezoelectric actuator. The voltage rise 4 causes the piezoelectric actuator to begin to move towards a deflected position, thereby producing a negative pressure wave that begins to begins to propagate both forwardly and rearwardly through an ink-carrying channel directly or indirectly coupled thereto.

Once reaching a first or peak value, the voltage waveform 2 enters a dwell state 5, typically having a duration of about 15 μsec, during which the voltage is held constant at the first value to hold the piezoelectric actuator in the deflected position. While the voltage waveform 2 is held in the dwell state 5, the rearwardly propagating negative pressure wave will have reflected off the back wall of the printhead and propagated forwardly within the channel as a positive pressure wave to its initial position. When the forwardly propagating reflected pressure wave reaches its initial position, the voltage waveform 2 begins a rapid fall 6, typically on the order of about 5 μsec in duration, back to the rest state 3. During the fall 6, the voltage applied across the actuator drops from the first value back to the rest state voltage and the piezoelectric actuator returns to its original position, thereby producing a positive pressure wave which reinforces the forwardly propagating, reflected pressure wave. The forwardly propagating reinforced pressure wave then travels to the front end of the channel where it ejects a droplet of ink therefrom.

Figure 2:
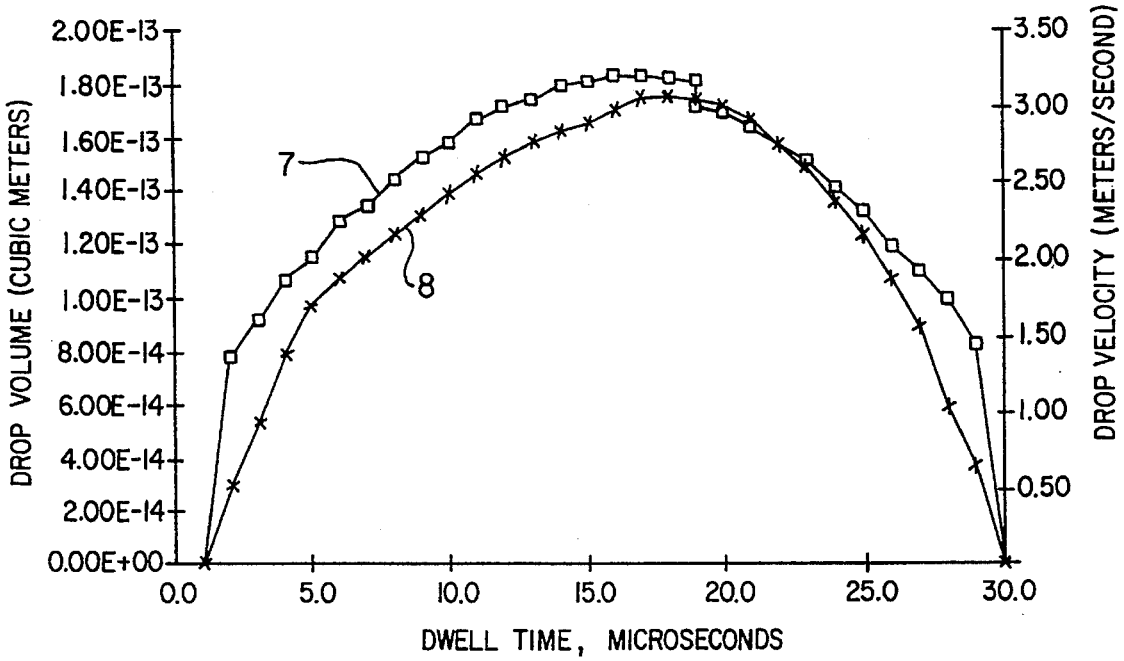
FIG. 2 is a graphical illustration of drop volume and velocity vs. dwell time for the standard, trapezoidal, pulse of FIG. 1.

Referring next to FIG. 2, the variation of droplet velocity and volume for ink ejected from a channel of an ink jet printhead by a standard, trapezoidal pulse such as that illustrated in FIG. 1, versus the period of time during which the standard, trapezoidal pulse remained in the dwell state 5 (or "dwell time") will now be described in greater detail. As may now be seen, as the dwell time for the standard, trapezoidal pulse is varied, both the volume 7 and the velocity 8 of a droplet ejected by the standard, trapezoidal pulse are varied as well. The optimal dwell time, i.e. when the largest, fastest droplet is produced, is about 17.5 μsec. If, however, the dwell time is shorter or longer than the optimal dwell time, a slower and smaller droplet will be produced.

Since it is possible to reduce the volume 7 of a droplet ejected by the standard, trapezoidal pulse by varying the dwell time, it is possible to modulate spot size using this pulse sequence. However, as clearly illustrated in FIG. 2, droplet velocity 8 is proportionately reduced when the dwell time is varied. For example, when the dwell time is reduced from 17.5 μsec to 8 μsec, droplet volume is reduced from $1.8\times10^{-13}$ to $1.4\times10^{-13}$ $m^3$ (a volume reduction ratio of about 1.2:1) while droplet velocity is reduced from 3.1 m/sec to 2.2 m/sec (a velocity reduction ratio of about 1.4:1). Thus, any attempt at reducing the volume of the droplet a sufficient amount to modulate the size of a spot produced thereby will cause a proportionately greater reduction in velocity. Such a reduction in velocity can change the trajectory of the droplet, thereby creating a first displacement error, and will cause an arrival time error which, because the sheet of paper and/or printhead may be moving, causes a second displacement error. Accordingly, as the printhead's ability to precisely locate ink droplets striking the sheet is significantly reduced whenever attempting to modulate the volume of a droplet produced by a standard, trapezoidal pulse, spacial resolution will be degraded whenever dwell time modulation for a standard, trapezoidal pulse is used in an attempt to modulate spot size.

Figure 3:
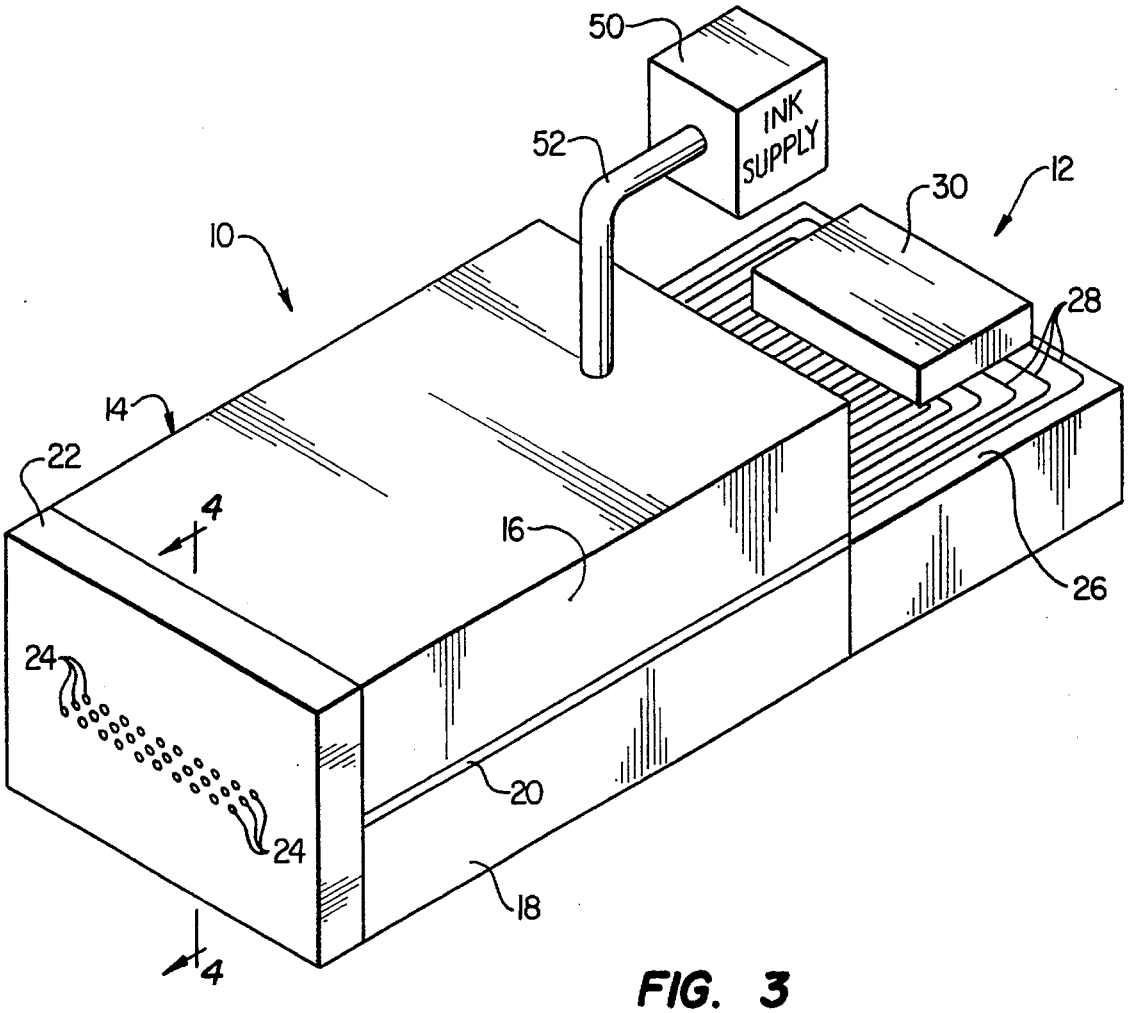
FIG. 3 is a perspective view of an ink jet printhead having a plurality of ink-carrying channels suitable for ejecting volume modulatable droplets of ink therefrom in accordance with the teachings of the present invention.
Figure 4:
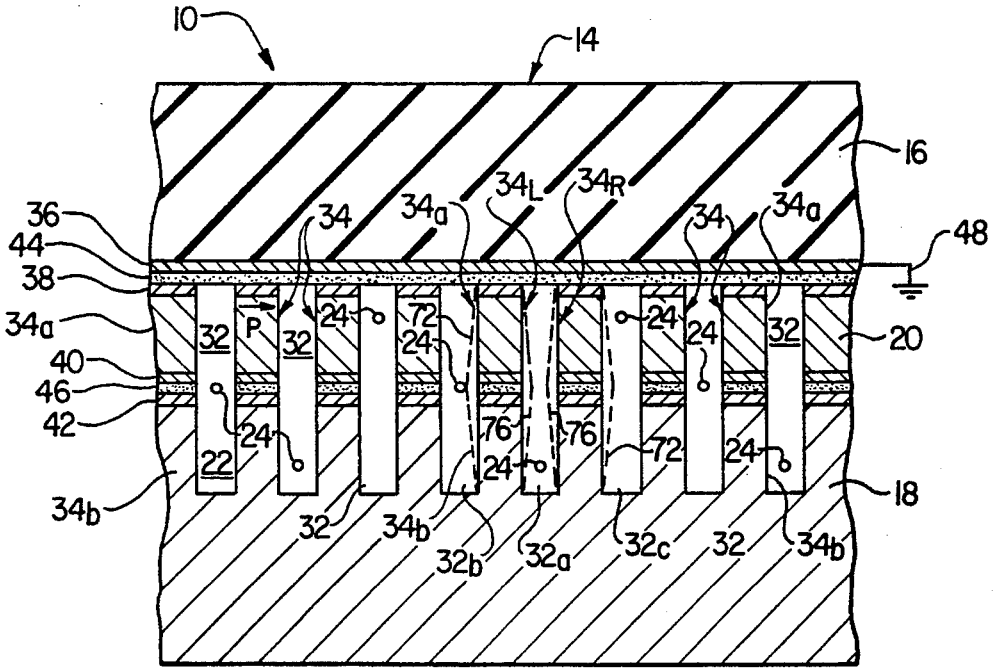
FIG. 4 is an enlarged scale partial cross-sectional view through the printhead taken along line 4—4 of FIG. 3.

Referring next to FIGS. 3 and 4, an ink jet printhead 10 having a plurality of ink-carrying channels 32 and a digital drive system 12 configured to generate pressure pulses within the channels 32 in accordance with the teachings of the present invention may now be seen. In the embodiment of the invention illustrated herein, the ink jet printhead 10 is arranged in a configuration known as an "I-field" configuration in which the printhead 10 includes a body 14 having upper and lower rectangular portions 16 and 18, both formed of an inactive material such as a ceramic material, with an intermediate rectangular body portion 20, secured between the upper and lower portions 16 and 18 in the indicated aligned relationship therewith and formed of an active piezoelectric material poled in direction P (see FIG. 4). It is contemplated, however, that in alternate embodiments of the invention, the ink jet printhead 10 may be arranged in a "U-field" configuration such as that disclosed in co-pending U.S. patent application Ser. No. 07/746,521 filed Aug. 16, 1991, U.S. Pat. No. 5,227,813, or in a "UU-field" configuration such as that disclosed in co-pending U.S. patent application Ser. No. 07/859,671 filed Mar. 30, 1992, U.S. Pat. No. 5,400,064, both of which are assigned to the Assignee of the present invention and are hereby incorporated by reference as if reproduced in their entirety. A front end section of the body 14 is defined by an orifice plate member 22 having a spaced series of small ink discharge orifices 24 extending rearwardly therethrough. As shown, the orifices 24 are arranged in horizontally sloped rows of three orifices each.

In a left-to-right direction as viewed in FIG. 3, the printhead body portions 16,20 are shorter than the body portion 18, thereby leaving a top rear surface portion 26 of the lower printhead body portion 18 exposed. For purposes later described, a spaced series of electrical actuation leads 28 are suitably formed on the exposed surface 26 and extend between the underside of the intermediate body portion 20 and a controller portion 30 of the drive system 12 mounted on the surface 26 near the rear end of the body portion 18. Further details regarding the drive system 12 for generating a series of acoustic pressure pulses in accordance with the teachings of the present invention are disclosed in co-pending U,S. patent application Ser. No. 08/060,297 entitled "Dual Element Switched Digital Drive System For An Ink Jet Printhead", Ser. No. 08/060,298 entitled "Three Element Switched Digital Drive System For an Ink Jet Printhead" and Ser. No. 08/060,440 entitled "Spot Size Modulatable Ink Jet Printhead", all of which were previously incorporated by reference.

Referring now to FIG. 4, a plurality of vertical grooves of predetermined width and depth are formed in the printhead body portions 18 and 20 to define within the printhead body 14 a spaced, parallel series of internal ink receiving channels 32 that longitudinally extend rearwardly from the orifice plate 22 (See FIG. 3) and open at their front ends outwardly through the orifices 24. The channels 32 are laterally bounded along their lengths by opposed pairs of a series of internal actuation sidewall sections 34 of the printhead body.

In the embodiment of the invention illustrated herein, sidewall sections 34 have active upper parts **34*a* defined by horizontally separated vertical sections of the body portion 20 and poled in direction P, and inactive lower parts 34*b* defined by horizontally separated sections of the body portion 18. The underside of the body portion 16, the top and bottom sides of the active actuation sidewall section parts 34*a*, and the top sides of the inactive actuation sidewall section parts 34*b* are respectively coated with electrically conductive metal layers 36, 38,40 and 42**.

Body portions 16 and 20 are secured to one another by a layer of electrically conductive adhesive material 44 positioned between the metal layers 36 and 38, and the upper and lower actuator parts 34*a* and 34*b* are intersecured by layers of electrically conductive material 46 positioned between the metal layers 40 and 42. The metal layer 36 on the underside of the upper printhead body portion 16 is connected to ground 48. Accordingly, the top sides of the upper actuator parts 34*a* are electrically coupled to one another and to ground 48 via the metal layers 38, the conductive adhesive layer 44 and the metal layer 36.

Each of the channels 32 is filled with ink received from a suitable ink supply reservoir 50 (see FIG. 3) connected to the channels 32 via an ink delivery conduit 52 connected to an ink supply manifold (not shown) disposed within the printhead body 14 and coupled to rear end portions of the internal channels 32. In a manner subsequently described, each horizontally opposed pair of the sidewall actuators 34 is piezoelectrically deflectable into and out of their associated channel 32, under the control of the drive system 12, to force ink (in droplet form) outwardly through the orifice 24 associated with the actuated channel.

Referring again to FIGS. 3 and 4, as previously mentioned, the drive system 12 includes the controller 30 which is operatively connected to rear ends of the electrical actuation leads 28. The front ends of the leads 28 are individually connected to the metal layers 42 on the top side surfaces of the lower actuator parts 34*b*. Within the controller 30 are a series of switching structures (not shown) each of which has an output connected to one of the leads 28. When the controller 30 desires to eject a droplet of ink from a selected channel 32, the controller 30 will assert and/or deassert plural control inputs to the switching structure to cause the switching structure to output a first voltage waveform having a desired shape to the lead 28 electrically connected to a first piezoelectric sidewall actuator 34 partially defining the channel 32 to be actuated while a second switching structure, also under the control of the controller 30, outputs a second, opposite voltage waveform to a second piezoelectric sidewall actuator 34 partially defining the channel 32 to be fired.

Figure 5:
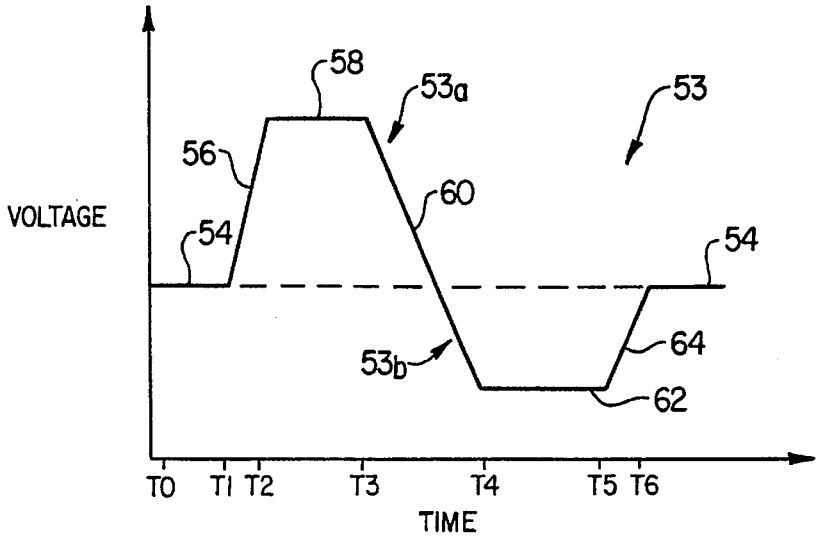
FIG. 5 is a graphical illustration of an echo pulse for piezoelectrically imparted to a selected channel of the ink jet printhead of FIGS. 3–4 to cause the ejection of a volume modulatable droplet of ink therefrom.

Referring next to FIG. 5, a voltage waveform 53, also referred to as an echo pulse waveform, which includes primary and echo portions 53*a*, 53*b* for generating a pressure wave in an ink-carrying channel of an ink jet printhead to cause the ejection of a droplet of ink, the volume of which may be dramatically modulated while a nearly constant ejection velocity is maintained, in accordance with the teachings of the present invention will now be described in greater detail. From a rest state 54, during which a rest state voltage is applied across a piezoelectric actuator 34 and the actuator remains in a undeflected rest position, the voltage waveform 53 begins a rapid rise 56 at time $T_1$ in the voltage applied across the piezoelectric actuator 34. The voltage rise 56 causes the piezoelectric actuator 34 to begin to move towards a first, outwardly deflected position, thereby producing an expansive pressure wave that begins to propagate both forwardly and rearwardly through an ink-carrying channel 32 partially defined thereby.

Once reaching a first or peak value at time $T_2$, the voltage waveform 53 enters a primary dwell state 58 which extends from time $T_2$ to time $T_3$. During the primary dwell state 58, the voltage is held constant at the first value to hold the piezoelectric actuator 34 in the deflected position. While the voltage waveform 53 is held in the dwell state 58, the rearwardly propagating negative pressure wave will have reflected off the back wall of the printhead 10 and propagated forwardly, as a positive pressure wave, within the channel 32 to its origination point. When the forwardly propagating reflected pressure wave reaches its origination point at time $T_3$, the voltage waveform 53 begins a rapid fall 60 during which the voltage drops below the rest voltage (thereby ending the primary portion 53*a* and beginning the echo portion 53*b* of the echo pulse 53) to a second, lower value at time $T_4$. During the fall 60, the voltage applied across the piezoelectric actuator 34 drops to the second value, thereby causing the piezoelectric actuator 34 to move, from the first, outwardly deflected position, past the rest position, and into a second, inwardly deflected position which compresses the channel 32. By compressing the channel 32, the piezoelectric actuator 34 imparts a positive pressure wave into the channel which reinforces the forwardly propagating, reflected pressure wave. Furthermore, as the fall 60 for the echo pulse 53 is greater than the fall 6 for a standard, trapezoidal pulse 2, the positive reinforcement of the forwardly propagating, reflected pressure wave is greater that the positive reinforcement achieved by the standard, trapezoidal pulse 2.

Once reaching the second, lower value, the voltage waveform 53 enters an echo dwell state 62 which extends from time $T_4$ to time $T_5$. During this state, the voltage is held constant at the second value to hold the piezoelectric actuator 34 in the second, channel compressing, deflected position. While the voltage waveform 53 is held in the echo dwell state 62, the forwardly propagating reinforced pressure wave will propagate towards the orifice 24. At time $T_5$, the voltage waveform 53 will begin a second rise 64 which will return the voltage waveform 53 to the rest state 54 at time $T_6$. The piezoelectric actuator 34 will move from the second, channel compressing, deflected position to the rest position, thereby imparting a negative pressure wave into the channel 32. This negative pressure wave acts as an active pull-up which prematurely terminates the droplet formation process by the forwardly propagating reinforced pressure pulse. Having returned to the rest state, the voltage waveform 53 remains at this state to allow the pressure pulse within the channel 34 to dissipate over time. In an exemplary embodiment of the invention, the rest, first and second voltages may be 0, +24 and −24 volts, respectively, the rise, fall, and return times may all be 5 μsec and the dwell and echo dwell times may both be 15 μsec. It is further contemplated that the rise, fall and return times may be effectively reduced to zero if a suitably configured digital switching system such as that disclosed in the above-referenced copending patent applications is incorporated as part of the controller 30.

Referring next to FIGS. 4 and 5, an illustrative actuation of a channel to drive a quantity of ink therein, in droplet form, outwardly through the associated ink discharge orifice 24 will now be described in greater detail. Prior to the actuation of the channel 32*a*, its horizontally opposed left and right sidewall actuators $34_L$ and $34_R$ are (at time $T_0$ in FIG. 5) in initial, laterally undeflected (or "rest") positions indicated by solid lines in FIG. 4. To eject a droplet of ink from a channel, the voltage waveform 53 is applied to a first piezoelectric sidewall actuator 34 partially defining a channel 32 while a second voltage waveform of opposite polarity, relative to the rest state voltage 54, to the voltage waveform 56 is simultaneously applied to a second piezoelectric sidewall actuator defining that channel 32 to initiate the channel actuation cycle. Accordingly, at time $T_1$, the left sidewall actuator $34_L$ would have the voltage rise 56 imposed thereon during the time interval $T_1$–$T_2$, reaching the primary dwell state 58 where a constant positive voltage is applied thereto, at time $T_2$. Simultaneously, at time $T_1$, the right sidewall actuator $34_R$ would have an equal negative voltage drop imposed thereon during the time interval $T_1-T_2$, reaching a negative dwell state where a constant negative voltage (relative to the rest voltage) is applied thereto at time $T_2$. These opposite polarity voltage pulses transmitted to the sidewall actuators $34_L$ and $34_R$ outwardly deflect them away from the channel 32*a* being actuated and into the outwardly adjacent channels 32*b* and 32*c* as indicated by the dotted lines 72 in FIG. 2, thereby imparting respective compressive pressure pulses to the channels 32*b* and 32*c* and expansive pressure pulses to the channel 32*a* which propagate forwardly and rearwardly in the channels 32*a*, 32*b* and 32*c*. As the sidewall actuators $34_L$ and $34_R$ are held in the outwardly deflected position, the rearwardly propagating negative pressure pulse imparted to the channel 32*a* reflects off the back wall (not shown) of the ink jet printhead 10 and begins to propagate forwardly in the channel 32*a* as a positive pressure pulse.

Next, at time $T_3$, the positive voltage pulse 70 transmitted to sidewall actuator $34_L$ and the corresponding negative, relative to the rest state voltage 54, voltage pulse on the sidewall actuator $34_R$ are terminated and left sidewall actuator $34_L$ has the voltage fall 60 imposed thereon during the time interval $T_3-T_4$, reaching the echo dwell state 62 where a constant negative, relative to the rest state voltage 54, voltage is applied thereto, at time $T_4$. Simultaneously, at time $T_3$, the right sidewall actuator $34_R$ would have an equal positive voltage rise imposed thereon during the time interval $T_3-T_4$, reaching a positive echo dwell state where a constant positive voltage is applied thereto at time $T_4$. These opposite voltage pulses inwardly deflect the sidewall actuators $34_L$ and $34_R$ past their initial undeflected positions and into the channel 32*a* as indicated by the dotted lines 76 in FIG. 2, thereby simultaneously imparting respective compressive pressure pulses into the channel 32*a* which reinforces the forwardly propagating reflection of the pressure wave imparted during the outward deflection of the sidewall actuators $34_L$ and $34_R$. Such inward deflection of the actuators $34_L$ and $34_R$ reduces the volume of channel 32*a*, thereby elevating the pressure of ink therein to an extent sufficient to initiate droplet formation whereby a quantity of the ink is propagated forwardly within the actuated channel 32*a* towards the orifice 24 for ejection therefrom. Next, at time $T_5$, the negative, relative to rest state voltage 54, voltage pulse 62 applied to sidewall actuator $34_L$ and the corresponding positive voltage pulse applied to the sidewall actuator $34_R$ are terminated and the left sidewall actuator $34_L$ has the second voltage rise 64 imposed thereon during the time interval $T_5-T_6$, returning to the rest state 54 at time $T_6$. Simultaneously, at time $T_5$, the right sidewall actuator $34_R$ would have an equal negative, relative to the rest state voltage 54, voltage fall imposed thereon during the time interval $T_5-T_6$, returning to the rest state at time $T_6$. Thus, the sidewall actuators $34_L$ and $34_R$ are outwardly deflected back to their respective rest positions. The outward deflection back to the rest position cancels out forwardly propagating pressure waves within the actuated channel 32*a*, thereby causing the premature termination of the formation of the ink droplet within the actuated channel 32*a* such that the volume of the droplet to be ejected therefrom is determined by the time at which the sidewall actuators $34_L$ and $34_R$ are driven back to the rest position. The sidewall actuators $34_L$ and $34_R$ are then held at the rest state voltage 54 until any remaining pressure waves within the actuated channel 32*a* subside over time.

Figure 6:
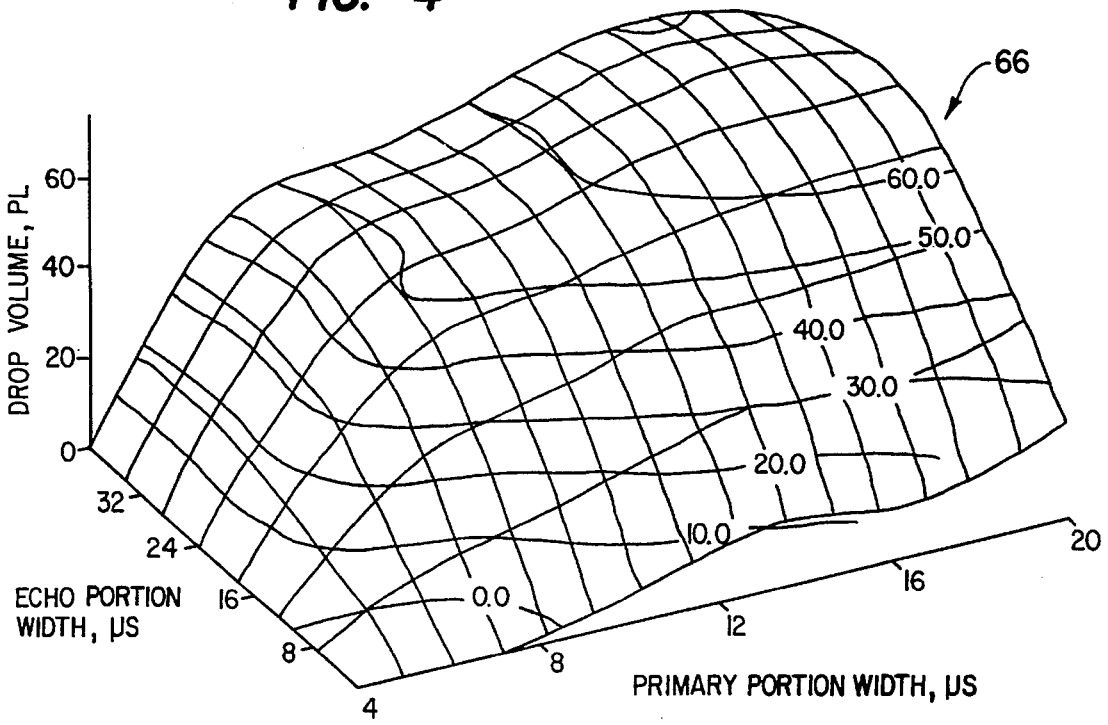
FIG. 6 is a three dimensional graphical illustration of the relationship between the primary and echo portions of the echo pulse of FIG. 5 and the volume of a droplet of ink ejected thereby.

Referring next to FIG. 6, the relationship between the volume of a droplet of ink ejected by the actuation of the channel 32*a* and the duration of the primary and echo portions 53*a* and 53*b* of the echo pulse 53 of FIG. 5 may now be seen. As illustrated in FIG. 6, the volume of the ejected droplet will vary depending on the selected duration of the primary portion 53*a* and the echo portion 53*b* of the echo pulse 53. The steeper slopes on the illustrated three-dimensional plot are those areas where the drop volume undergoes its most dramatic variance due to changes in the duration of the primary and echo portions 53*a* and 53*b*. Accordingly, the most steeply sloping areas are of particular interest initially.

Figure 7:
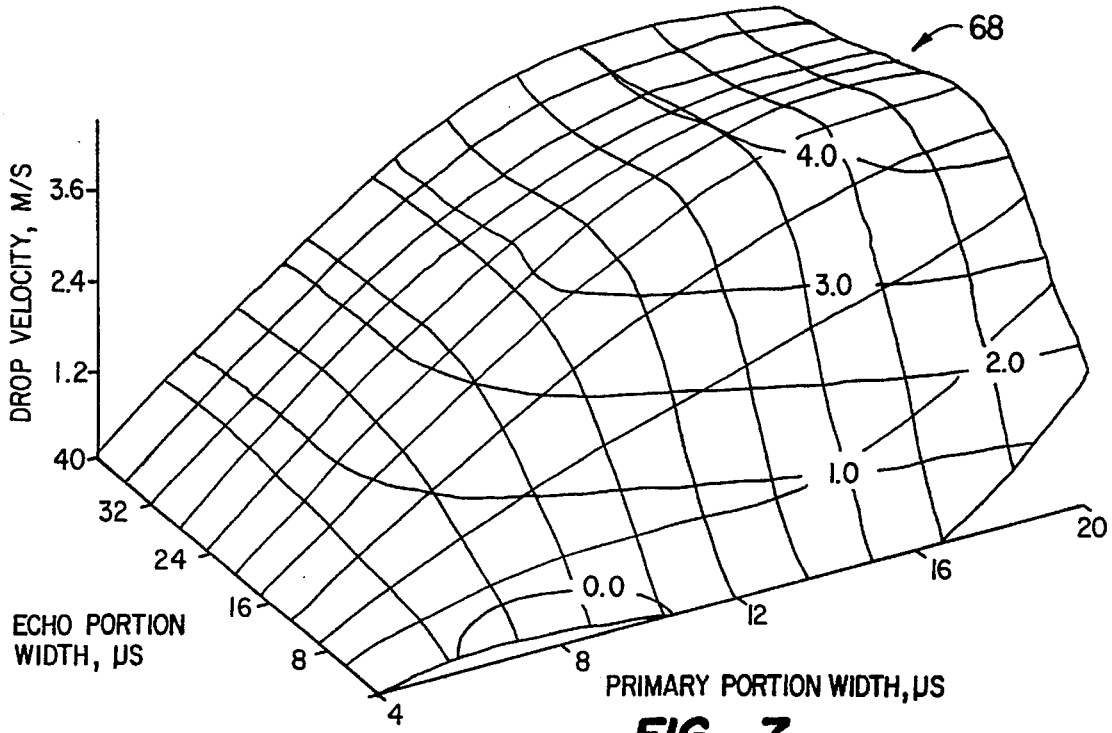
FIG. 7 is a three dimensional graphical illustration of the relationship between the width of primary and echo portions of the echo pulse of FIG. 5 and the velocity of a droplet of ink ejected thereby.

Referring next to FIG. 7, the relationship between the velocity of a droplet of ink ejected by the actuation of the channel 32*a* and the duration of the primary and echo portions 53*a* and 53*b* of the echo pulse 53 of FIG. 5 may now be seen. As before, the velocity of the ejected droplet varies depending on the selected durations of the primary portion 53*a* and the echo portion 53*b* of the echo pulse 53. As it is desired to minimize any changes in the ejection velocity of the droplet, those areas of the illustrated three-dimensional plot in which the plot is most nearly level would be of greater initial interest.

Figure 8B:
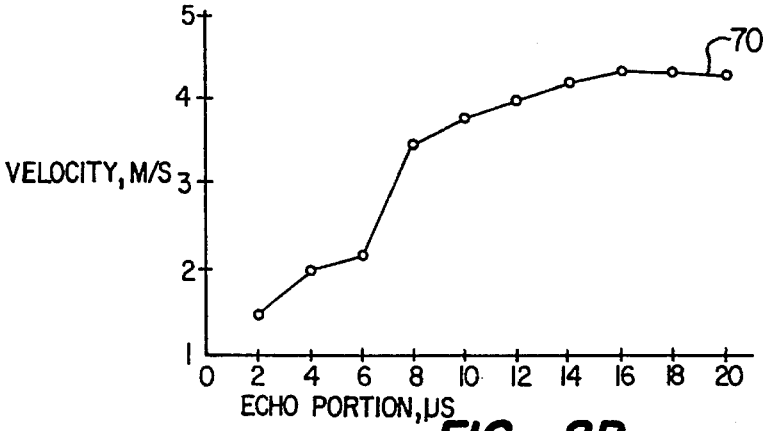
FIG. 8B is a graphical illustration of the relationship between the width of the echo portion of the echo pulse, relative to a constant width primary portion, and the volume of a droplet of ink ejected thereby.
Figure 8A:
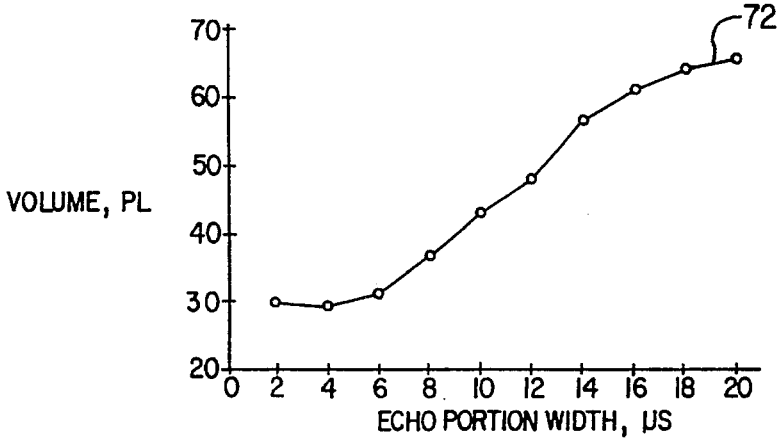
FIG. 8A is a graphical illustration of the relationship between the width of the echo portion of the echo pulse, relative to a constant width primary portion, and the velocity of a droplet of ink ejected thereby.

Taken together, the three-dimensional plots of FIGS. 6 and 7 may be used to identify the preferred pulse durations for the primary and echo portions 53*a* and 53*b* of the echo pulse 53. Specifically, those primary and echo portion pulse durations where the slope in the three-dimensional plot of drop volume was the greatest and the slope in the three-dimensional plot of drop velocity was minimal are the pulse durations which would most suitable for use herein. A two dimensional slice in the three-dimensional plot of drop volume of FIG. 6 taken at the 20 μsec primary portion line is illustrated in FIG. 8A and the same slice, when taken in the three-dimensional plot of drop velocity of FIG. 7 is illustrated in FIG. 8B. These graphs illustrate the variance in volume and velocity, respectively, of a droplet ejected from the actuated channel 32*a* by an echo pulse 53 having a 20 μsec primary portion 58 and a variable length echo portion 62. As may now be seen, while both the volume and velocity of a droplet ejected using the echo pulse 53 increases as the duration of the echo portion 53*b* increases, there is a segment thereof where the rate at which the droplet volume increases is significantly greater than the rate at which the droplet velocity increases. This represents a significant departure from the standard, trapezoidal pulse where the relationship between volume and velocity was much more constant. More specifically, FIGS. 8A–B indicate that, for a constant primary portion width of 20 μsec., a droplet of ink ejected by the techniques described herein will have a volume of 35 pl. when ejected by an echo pulse having an 8 μsec. echo portion but will have a volume of 65 pl. when ejected by an echo pulse having a 20 μsec echo portion. More importantly, however, the 35 pl. droplet will be ejected at a velocity of 3.5 m/sec. while the 65 pl. droplet will be ejected at a velocity of 4.2 m/sec. This represents a more than 1.8:1 (80%+) increase in the volume of the droplet for only a 1.2:1 (20%) increase in droplet velocity.

Thus, there has been described and illustrated herein, various techniques in which the volume of a droplet ejected by an ink-jet printhead may be dramatically varied without a significant variance in the ejection velocity of the droplet have been disclosed herein. By this discovery of an ink ejection pulse sequence which achieves this variance in the relationship between volume and velocity, a drop-on-demand type ink jet printhead capable of accurately placing, on a sheet of paper, spot size modulatable droplets of ink is now possible.

The foregoing detailed description is to be clearly understood as being given by way of illustration and example only, the spirit and scope of the present invention being limited solely by the appended claims.

What is claimed is:

1. A method of operatively driving a piezoelectric sidewall actuator of an ink jet printhead to eject a droplet of ink from an ink-carrying channel at least partially defined by said sidewall actuator, comprising the steps of:

selecting a volume for said droplet of ink to be ejected from said ink-carrying channel;

selecting, based upon said selected volume for said droplet of ink to be ejected from said ink-carrying channel, first and second periods of time;

generating a rearwardly propagating pressure wave in said ink-carrying channel by raising, from a rest voltage, the voltage applied across said sidewall actuator to a first voltage, thereby deflecting said sidewall actuator, from a rest position, to a first position;

reflecting said rearwardly propagating pressure wave off of a rear wall partially defining said ink-carrying channel as a first forwardly propagating pressure wave by maintaining said first voltage applied to said sidewall actuator for said first period of time;

reinforcing said first forwardly propagating pressure wave with a second forwardly propagating pressure wave by dropping, from said first voltage, the voltage applied across said sidewall actuator, to a second voltage, said second voltage being lower than said rest voltage, thereby deflecting said sidewall actuator, from said first position, past said rest position, and to a second position;

propagating said reinforced forwardly propagating pressure wave towards a front end of said ink-carrying channel by maintaining said second voltage applied to said sidewall actuator for said second period of time; and terminating said forwardly propagating reinforced pressure wave and ejecting said droplet of ink having said selected volume from said front end of said ink-carrying channel by returning, from said second voltage, the voltage applied across said sidewall actuator, to said rest voltage.

2. A method according to claim 1 wherein said second time period is held constant and said first time period is varied, relative to said second time period, to select said droplet volume for ink ejected from said ink-carrying channel.

3. A method according to claim 1 wherein said first time period is held constant and said second time period is varied, relative to said first time period, to select said droplet volume for ink ejected from said ink-carrying channel.

4. A method according to claim 3 wherein said first period of time is 20 μsec and said second period of time may be varied between 8–20 μsec to select a droplet volume between 35–65 pl.

5. A method according to claim 4 wherein the voltage differential between said first voltage and said second voltage is twice the voltage differential between said rest voltage and said first voltage.

6. A method according to claim 5 wherein said first voltage is approximately 24 volts above said rest voltage and said second voltage is approximately 24 volts below said rest voltage.

7. A method according to claim 6 wherein said rest voltage is zero volts.

8. A method according to claim 3 wherein said second period of time is varied, relative to said first period of time, between a ratio of about 0.4 and a ratio of about 1.0 to produce a variably sized droplet volume.

9. A method of ejecting a volume modulatable droplet of ink from a first ink-carrying channel of an ink jet printhead having a plurality of ink-carrying channels, each of said ink-carrying channels separated from an adjacent ink-carrying channel by a sidewall actuator, comprising the steps of:

selecting a volume for said volume modulatable droplet of ink to be ejected from said first ink-carrying channel;

selecting, based upon said selected volume for said volume modulatable droplet of ink to be ejected from said first ink-carrying channel, first and second periods of time;

generating a rearwardly propagating pressure wave in said first ink-carrying channel by imparting an expansive pressure pulse into said first ink-carrying channel by deflecting first and second sidewall actuators partially defining said first ink-carrying channel such that said first ink-carrying channel is expanded and second and third ink-carrying channels partially defined by said first and second sidewall actuators, respectively, are compressed;

reflecting said rearwardly propagating pressure wave off of a rear wall partially defining said first ink-carrying channel as a first forwardly propagating pressure wave by maintaining said expansive pressure pulse for said first period of time;

reinforcing said first forwardly propagating pressure wave with a second forwardly propagating pressure wave by imparting a compressive pressure pulse into said first ink-carrying channel by deflecting said first and second sidewall actuators such that said first ink-carrying channel is compressed and said second and third ink-carrying channels are expanded;

propagating said reinforced forwardly propagating pressure wave towards a front end of said first ink-carrying channel by maintaining said compressive pressure pulse for said second period of time;

terminating said reinforced forwardly propagating pressure wave and ejecting a droplet of ink having said selected volume from said front end of said first ink-carrying channel by removing said compressive pressure pulse.

10. A method according to claim 1 wherein said second time period is held constant and said first time period is varied, relative to said second time period, to select said droplet volume for ink ejected from said first ink-carrying channel.

11. A method according to claim 1 wherein said first time period is held constant and said second time period is varied, relative to said first time period, to select said droplet volume for ink ejected from said first ink-carrying channel.

12. A method according to claim 11 wherein said second period of time is varied, relative to said first period of time, between a ratio of about 0.4 and a ratio of about 1.0 to produce a variably sized droplet volume.

13. A method according to claim 12 wherein said second period of time is varied, relative to said first period of time, to produce a droplet having a volume variably sized at a 1.8:1 ratio.

14. A method according to claim 9 wherein the step of terminating said reinforced forwardly propagating pressure wave further comprises the step of imparting an active pull-up pressure pulse into said first ink-carrying channel, said active pull-up pressure pulse terminating formation of said droplet of ink.

15. A method of ejecting a volume modulatable droplet of ink from a selected ink-carrying channel at a modulatable droplet velocity of an ink jet printhead having a plurality of ink-carrying channels, each said ink-carrying channel having a rear wall, a front end, and separated from an adjacent ink-carrying channel by a sidewall actuator, comprising the steps of:

selecting, from a 1.8:1 modulatable range, a volume for said droplet of ink to be ejected from said selected ink-carrying channel;

selecting, from a 1.2:1 modulatable range, a velocity for said droplet of ink to be ejected from said selected ink-carrying channel;

selecting, based upon said selected volume and said selected velocity for said droplet of ink to be ejected by said selected ink-carrying channel, first and second periods of time;

generating, at an originating location within said selected ink-carrying channel, a first rearwardly propagating pressure wave by deflecting first and second sidewall actuators partially defining said selected ink-carrying channel from first and second rest positions into first and second deflected positions such that said selected ink-carrying channel is expanded and first and second ink-carrying channels partially defined by said first and second sidewall actuators, respectively, are compressed;

reflecting said rearwardly propagating pressure wave off of a rear wall partially defining said selected ink-carrying channel as a forwardly propagating pressure wave by maintaining said first and second sidewall actuators in said first and second deflected positions, respectively, for said first period of time;

propagating said forwardly propagating wave to said originating location by maintaining said first and second sidewall actuators in said first and second deflected positions, respectively, for said second period of time;

reinforcing said forwardly propagating pressure wave with a second forwardly propagating pressure wave by deflecting said first and second sidewall actuators from said first and second deflected positions to third and fourth deflected positions, respectively, such that said selected ink-carrying channel is compressed and said first and second ink-carrying channels are expanded;

propagating said reinforced forwardly propagating pressure wave towards said front end by maintaining said first and second sidewall actuators in said third and fourth deflected positions, respectively, for said second period of time;

ejecting said droplet of ink having said selected volume and said selected velocity from said selected ink-carrying channel by returning said first and second sidewall actuators to said first and second rest positions.

16. A method according to claim 15 wherein said second time period is held constant and said first time period is varied, relative to said second time period, to select said droplet volume for ink ejected from said first ink-carrying channel.

17. A method according to claim 16 wherein said first time period is held constant and said second time period is varied, relative to said first time period, to select said droplet volume for ink ejected from said first ink-carrying channel.

18. A method of ejecting a volume modulatable droplet of ink from a selected ink-carrying channel of an ink jet printhead having a plurality of ink-carrying channels, each said ink-carrying channel separated from an adjacent ink-carrying channel by a sidewall actuator and at least partially defined by a corresponding sidewall actuator, comprising the steps of:

selecting a volume for a droplet of ink to be ejected from said selected ink-carrying channel;

selecting, based upon said selected volume, first and second periods of time;

generating a rearwardly propagating pressure wave in said selected ink-carrying channel by deflecting said corresponding sidewall actuator from a rest position into a first deflected position to impart a primary pressure pulse to said selected ink-carrying channel;

reflecting said rearwardly propagating pressure wave off of a rear wall partially defining said selected ink-carrying channel as a forwardly propagating pressure wave by maintaining said primary pressure pulse for said first period of time;

reinforcing said forwardly propagating pressure wave with a second forwardly propagating pressure wave by deflecting said corresponding sidewall actuator from said first deflected position, past said rest position., and into a second deflected position to impart an echo pressure pulse to said selected ink-carrying channel; and propagating said reinforced forwardly propagating pressure wave towards a front end of said selected ink-carrying channel by maintaining said echo pressure pulse for said second period of time.

19. A method according to claim 9 wherein said primary pulse includes a rise portion, a dwell portion and a fall portion and said echo pulse includes a fall portion, a dwell portion and a rise portion, and further comprising the step of varying, relative to each other, said dwell portions of said primary and echo pulses to select said droplet volume.

20. A method according to claim 18 wherein said echo pulse dwell portion is held constant and said primary pulse dwell portion is varied, relative to said echo pulse dwell portion, to select said droplet volume for ink ejected from said first ink-carrying channel.

21. A method according to claim 20 wherein said primary pulse dwell portion is held constant and said echo pulse dwell portion is varied, relative to said primary pulse dwell portion, to select said droplet volume for ink ejected from said first ink-carrying channel.

* * * * *